US009123317B2

(12) United States Patent
Watterson et al.

(10) Patent No.: US 9,123,317 B2
(45) Date of Patent: Sep. 1, 2015

(54) USING MUSIC TO MOTIVATE A USER DURING EXERCISE

(71) Applicant: ICON Health & Fitness, Inc., Logan, UT (US)

(72) Inventors: Scott R. Watterson, Logan, UT (US); Mark D. Watterson, Logan, UT (US); David Watterson, Logan, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 301 days.

(21) Appl. No.: 13/857,833

(22) Filed: Apr. 5, 2013

(65) Prior Publication Data

US 2013/0263719 A1 Oct. 10, 2013

Related U.S. Application Data

(60) Provisional application No. 61/621,216, filed on Apr. 6, 2012.

(51) Int. Cl.

| | |
|---|---|
| ***G10H 1/36*** | (2006.01) |
| ***G10H 7/00*** | (2006.01) |
| ***G10H 1/42*** | (2006.01) |

(52) U.S. Cl.

CPC ..... *G10H 7/002* (2013.01); *G10H 1/42* (2013.01); *G10H 2220/005* (2013.01); *G10H 2220/355* (2013.01); *G10H 2220/371* (2013.01); *G10H 2230/015* (2013.01)

(58) Field of Classification Search

CPC .... G01C 21/34; G01C 21/3676; G01C 21/00; G01C 21/26; G01C 21/20; G01C 22/006; G01C 19/00; G01C 21/165; G10H 2220/371; G10H 2240/131; G10H 2220/081; G10H 2220/101; G10H 2220/395; G10H 2210/076

See application file for complete search history.

(56) References Cited

U.S. PATENT DOCUMENTS

| | | | | |
|---|---|---|---|---|
| 6,808,473 | B2 | 10/2004 | Hisano et al. | |
| 7,683,252 | B2 | 3/2010 | Oliver et al. | |
| 7,705,230 | B2 | 4/2010 | Bowen | |
| 7,728,214 | B2 | 6/2010 | Oliver et al. | |
| 8,251,874 | B2 | 8/2012 | Ashby et al. | |
| 2007/0028749 | A1 * | 2/2007 | Basson et al. | 84/601 |
| 2007/0042868 | A1 * | 2/2007 | Fisher et al. | 482/8 |
| 2007/0079691 | A1 * | 4/2007 | Turner | 84/612 |
| 2008/0171945 | A1 * | 7/2008 | Dotter | 600/514 |
| 2008/0255430 | A1 * | 10/2008 | Alexandersson et al. | 600/300 |
| 2009/0024233 | A1 * | 1/2009 | Shirai et al. | 700/94 |
| 2009/0195350 | A1 * | 8/2009 | Tsern et al. | 340/3.1 |
| 2010/0022354 | A1 * | 1/2010 | Fisher | 482/8 |
| 2010/0035726 | A1 * | 2/2010 | Fisher et al. | 482/8 |
| 2011/0072955 | A1 * | 3/2011 | Turner | 84/612 |
| 2013/0228063 | A1 * | 9/2013 | Turner | 84/612 |
| 2013/0263719 | A1 * | 10/2013 | Watterson et al. | 84/609 |
| 2014/0135612 | A1 * | 5/2014 | Yuen et al. | 600/407 |
| 2014/0228649 | A1 * | 8/2014 | Rayner et al. | 600/301 |
| 2014/0358012 | A1 * | 12/2014 | Richards et al. | 600/479 |
| 2015/0081209 | A1 * | 3/2015 | Yeh et al. | 701/427 |
| 2015/0081210 | A1 * | 3/2015 | Yeh et al. | 701/428 |

* cited by examiner

*Primary Examiner* — Marlon Fletcher
(74) *Attorney, Agent, or Firm* — Holland & Hart LLP

(57) ABSTRACT

A method for motivating physical performance through music includes the acts of presenting a musical rendition to a user while concurrently receiving workout information. The workout information includes one or both of a current performance level of the user or a current geographical characteristic being traversed by the user. The method further includes modifying the musical rendition based on one or both of the current performance level of the user or the current geographical characteristic being traversed by the user.

20 Claims, 9 Drawing Sheets

200a

| Segment | Segment Parameters | Target Performance | Target Biometrics | Music Parameters |
|---|---|---|---|---|
| 202a | 0% Grade | 8 mph | 120 BPM | Song 1 (60 BPM) |
| 202b | 4% Grade | 5 mph | 160 BPM | Song 1 @ 80 BPM |
| 202c | 0% Grade | 7 mph | 130 BPM | Song 2 (60 BPM) |
| 202d | - 4% Grade | 9 mph | 130 BPM | Song 2 (60 BPM) |
| 202e | 0% Grade | 5 mph | 120 BPM | Song 3 (60 BPM) |

200b

200c

USING MUSIC TO MOTIVATE A USER DURING EXERCISE

CROSS-REFERENCE TO RELATED APPLICATIONS

This application claims priority to U.S. Provisional Patent Application No. 61/621,216 filed Apr. 6, 2012.

TECHNICAL FIELD

This disclosure relates generally to systems, methods, and computer program products for health and exercise. More particularly, the disclosure relates to systems, methods, and computer program products for dynamically using music to motivate a user during exercise.

BACKGROUND

Computerized exercise devices are being used at an ever-increasing rate. Individuals use exercise devices to improve their health and fitness level. Some computerized exercise devices (e.g., treadmills, elliptical trainers, spinning cycles, etc.) are stationary and include computer components that guide users through simulated workout programs having varying speed, resistance, incline, etc. Some stationary exercise devices are configured to provide a simulated geographical workout route to a user. For example, stationary exercise devices may include a computer display that presents pre-programmed simulated geographical routes. During a workout, the computer display may indicate a simulated location of the user on the simulated geographical route, and simulate physical geographic features (e.g., hills) with the stationary exercise device (e.g., by adjusting incline and/or resistance to simulate grade). For example, some exercise systems, such as the exercise system described in U.S. Pub. No. 2010/0248900 to Ashby, attempt to simulate real-world routes. Some stationary exercise devices are capable of receiving real-time biometric data (e.g., heart rate) for the user to track the user's physiological condition.

Other computerized exercise devices (e.g., cycle computers, heart rate monitors, cellular telephones that are configured with exercise 'apps', etc.) are portable. Portable exercise devices are commonly used during indoor and outdoor workouts to log workout performance data (e.g., speed, grade, power, geographic location, etc.) and/or biometric information (e.g., heart rate, caloric rate, blood oxygen level, etc.) for the user. Portable exercise devices may also guide users through predefined routes, such as routes previously traversed by the user when the user was wearing the portable exercise device.

In addition, many exercisers use portable media devices during their exercise routines to listen to music, workout programs, or other audio stimuli. Many exercisers find music to be a strong motivating influence during exercise. For example, listening to music during exercise can alleviate boredom and break up the monotony that some people experience during exercise. In addition, many people find that song properties (e.g., beat, tempo, rhythm, etc.) can have an effect on their workout performance. For example, some mechanisms for motivating people through music are described in U.S. Pat. No. 6,808,473, U.S. Pat. No. 7,683,252, U.S. Pat. No. 7,728,214, and U.S. Pat. No. 7,705,230.

SUMMARY OF THE INVENTION

In one example embodiment of the disclosure, a method for motivating physical performance through music includes accessing a geographical workout route, the geographical workout route including a first geographical characteristic and a second geographical characteristic. The method also includes accessing musical parameter data that is associated with a geographical workout route, the musical parameter data including one or more first musical parameters that are associated with a first geographical characteristic and one or more different second musical parameters that are associated with a second geographical characteristic. In addition, the method includes identifying first user activity that is associated with a first geographical characteristic and, as a result of the first user activity, preparing a first musical rendition in accordance with one or more first musical parameters for presentation to a user in connection with the first user activity. Furthermore, the method includes identifying second user activity associated with a second geographical characteristic and, as a result of the second user activity, preparing a second musical rendition in accordance with one or more second musical parameters for presentation to the user in connection with the second user activity.

In another aspect that may be combined with any of the aspects herein, target biometric data that is associated with a geographical workout route is accessed.

In another aspect that may be combined with any of the aspects herein, target biometric data includes one or more first target biometric parameters that are associated with a first geographical characteristic and one or more different second target biometric parameters that are associated with a second geographical characteristic.

In another aspect that may be combined with any of the aspects herein, user biometric data is received, the user biometric data including one or more biometric parameters representing a physiological state of a user during user activity.

In another aspect that may be combined with any of the aspects herein, it is determined that one or more biometric parameters of a user during a user activity do not conform to one or more target biometric parameters.

In another aspect that may be combined with any of the aspects herein, a musical rendition is modified, the modified musical rendition being configured to motivate a user to achieve target biometric parameters.

In another aspect that may be combined with any of the aspects herein, one or more musical parameters include a particular musical selection, and modifying a musical rendition comprises modifying one or more of a beat or a tempo of the particular musical selection to motivate a user to achieve target biometric parameters.

In another aspect that may be combined with any of the aspects herein, one or more musical parameters include a particular musical selection, and modifying a musical rendition comprises selecting a different musical selection having a different beat or tempo than the particular musical selection to motivate a user to achieve target biometric parameters.

In another aspect that may be combined with any of the aspects herein, one or more musical parameters include one or both of a desired beat or a desired tempo.

In another aspect that may be combined with any of the aspects herein, preparing a musical rendition in accordance with one or more musical parameters for presentation to a user in connection with a user activity comprises selecting a musical selection having one or both of a desired beat or a desired tempo.

In another aspect that may be combined with any of the aspects herein, modifying a musical rendition comprises modifying one or both of a beat or a tempo of a musical selection to motivate the user to achieve target biometric parameters.

In another aspect that may be combined with any of the aspects herein, geographical workout route and the musical parameter data are received, one or both of the geographical workout route or the musical parameter data being generated based on user input.

In another aspect that may be combined with any of the aspects herein, each of one or more first musical parameters and one or more second musical parameters include one or more of a particular musical selection, a beat, or a tempo.

In another aspect that may be combined with any of the aspects herein, preparing a first musical rendition in accordance with one or more first musical parameters for presentation to a user in connection with a first user activity and preparing a second musical rendition in accordance with one or more second musical parameters for presentation to the user in connection with a second user activity comprises preparing each musical rendition based on one or more of a musical selection, a beat, or a tempo specified in corresponding musical parameters.

In another aspect that may be combined with any of the aspects herein, identifying user activity that is associated with a geographical characteristic comprises identifying that a user is presently physically located within or presently physically approaching a corresponding geographical characteristic during a workout.

In another aspect that may be combined with any of the aspects herein, identifying user activity that is associated with a geographical characteristic comprises identifying that a user is presently located within or presently approaching a simulated corresponding geographical characteristic during a workout.

In another aspect that may be combined with any of the aspects herein, a first musical rendition is audibly presented to a user during a first user activity.

In another aspect that may be combined with any of the aspects herein, a second musical rendition is audibly presented to a user during a second user activity.

In another aspect that may be combined with any of the aspects herein, a geographical workout route comprises a simulated geographical workout route.

In another aspect that may be combined with any of the aspects herein, user biometric data is received, the user biometric data including one or more biometric parameters representing a physiological state of the user during a user activity.

In another aspect that may be combined with any of the aspects herein, it is determined that one or more biometric parameters of a user during a user activity do not conform to target biometric parameters.

In another aspect that may be combined with any of the aspects herein, based on determining that one or more biometric parameters of a user during a user activity do not conform to target biometric parameters, a musical rendition is modified, the modified musical rendition being configured to motivate the user to achieve the target biometric parameters.

In another aspect that may be combined with any of the aspects herein, based on determining that one or more biometric parameters of a user during a user activity do not conform to target biometric parameters, a simulated geographical workout route is modified, the modified simulated geographical workout route being configured to encourage the user to achieve the target biometric parameters.

In another aspect that may be combined with any of the aspects herein, target route performance data that is associated with a geographical workout route is accessed, the target route performance data including a target speed that is associated with a geographical characteristic.

In another aspect that may be combined with any of the aspects herein, user performance data is received, the user performance data including a current speed of a user during a user activity.

In another aspect that may be combined with any of the aspects herein, it is determined that the current speed of a user during a user activity does not conform to a target speed.

In another aspect that may be combined with any of the aspects herein, a musical rendition is modified, the modified musical rendition being configured to motivate a user to achieve a target speed.

In another aspect that may be combined with any of the aspects herein, geographical characteristics comprise expressly defined route segments.

In another aspect that may be combined with any of the aspects herein, geographical characteristics comprise one or more of grade or terrain type.

In another aspect of the disclosure, a method for designing a workout that motivates physical performance through music includes presenting a workout route creation user interface, the workout route creation user interface being configured to design a geographical workout route that includes a plurality of geographical characteristics.

In another aspect that may be combined with any of the aspects herein, a method for designing a workout that motivates physical performance through music includes receiving user input at a workout route creation user interface, the user input specifying a plurality of geographical characteristics of a geographical workout route.

In another aspect that may be combined with any of the aspects herein, a method for designing a workout that motivates physical performance through music includes receiving user input at a workout route creation user interface, the user input specifying one or more musical parameters for each of a plurality of geographical characteristics, the musical parameters for each geographical characteristic being configured to motivate particular physical activity of a user during the geographical characteristic.

In another aspect that may be combined with any of the aspects herein, a method for designing a workout that motivates physical performance through music includes associating one or more musical parameters for each of a plurality of geographical characteristics with a geographical workout route.

In another aspect that may be combined with any of the aspects herein, user input is received at a workout route creation user interface, the user input specifying one or more target biometric parameters for each of a plurality of geographical characteristics.

In another aspect that may be combined with any of the aspects herein, one or more target biometric parameters for each of a plurality of geographical characteristics are associated with a geographical workout route.

In another aspect that may be combined with any of the aspects herein, user input specifying one or more musical parameters for each of a plurality of geographical characteristics comprises user input specifying a particular song or playlist for each of the route segments.

In another aspect that may be combined with any of the aspects herein, a geographical workout route represents a simulated workout route.

In another aspect of the disclosure, a method for motivating physical performance through music includes presenting a musical rendition to a user.

In another aspect that may be combined with any of the aspects herein, a method for motivating physical performance through music includes, concurrent with presenting a musical rendition to a user, receiving workout information, the workout information comprising one or both of a current performance level of the user or a current geographical characteristic being traversed by the user.

In another aspect that may be combined with any of the aspects herein, a method for motivating physical performance through music includes modifying a musical rendition based on one or both of a current performance level of a user or a current geographical characteristic being traversed by the user.

DETAILED DESCRIPTION

Figure 1:
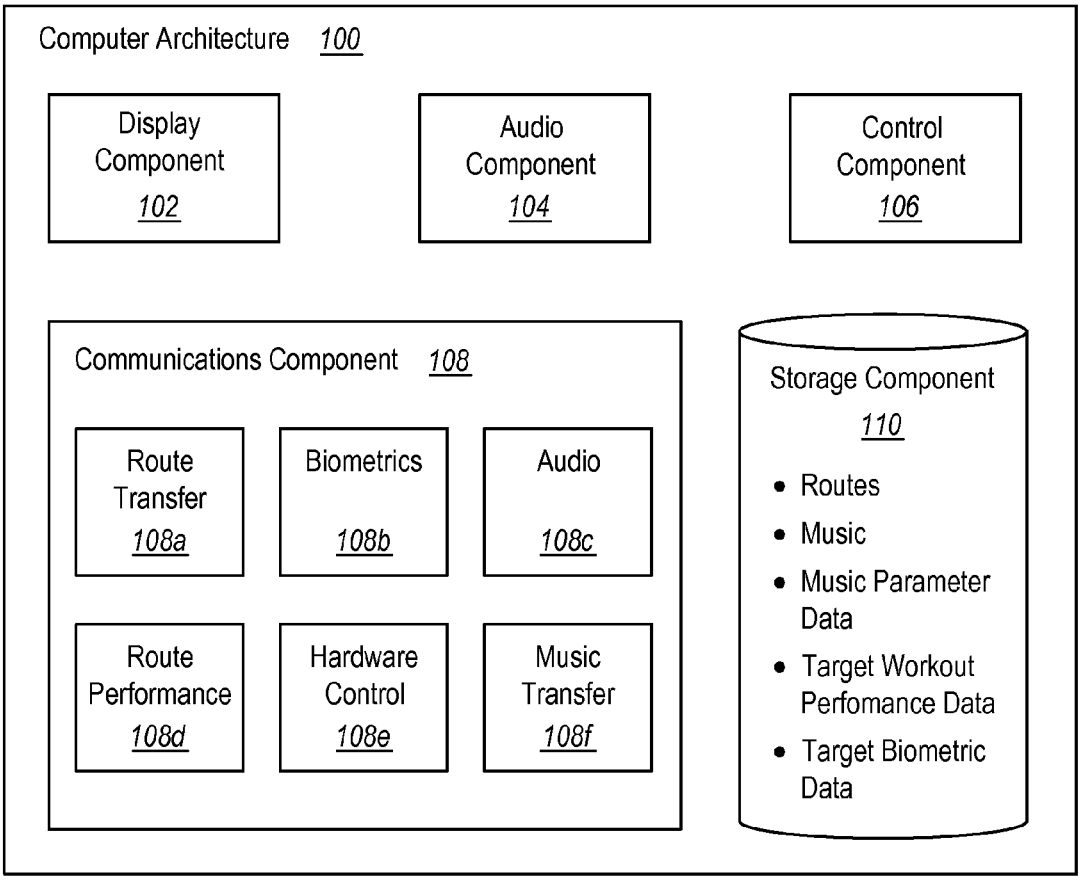
FIG. 1 illustrates a computer architecture for encouraging physical fitness through music according to one example embodiment of the present disclosure.

This disclosure relates generally to systems, methods, and computer program products for health and exercise. Depicted in FIG. 1 is a computer architecture 100 which encourages physical fitness performance, and which incorporates novel functionalities, software modules, and the like. Computer architecture 100 may be included as part of a stationary exercise system (e.g., a treadmill, an elliptical trainer, a spinning cycle, etc.), or may be part of a mobile device (e.g., a cycle computer, a heart rate monitor, a GPS device, a mobile telephone, a portable media device, etc.).

Computer architecture 100 is configured to encourage an individual to perform physical exercise at target levels through appropriate presentation of music or other audio. For example, computer architecture 100 may be used to generate or modify a musical rendering based on one or more of present physical location of the individual, present simulated geography, present physiological state of the individual (i.e., biometrics), present user performance, etc.

In one embodiment, which may be referred to as "Smart Heart," and which may be combined with any other embodiment herein, computer architecture 100 is configured to measure a user's pulse rate and to proactively provide a workout routine according to the pulse rate. For example, computer architecture 100 may dynamically choose a route or workout that is presented to the user based on the current pulse rate. The chosen route or workout may be designed to interact with the user's pulse rate in a particular manner (e.g., to increase the pulse rate, to decrease the pulse rate, or to maintain the pulse rate).

In another embodiment, which may be referred to as "Music Beat," and which may be combined with any other embodiment herein, computer architecture 100 is configured to reactively and dynamically choose a musical selection, or to alter musical parameters, based on a present workout state. For example, computer architecture 100 may change a song being played, or may alter characteristics the song being played (e.g., beats per minute (BPM)/tempo) based on the user's current workout performance (e.g., speed, grade, power generation, resistance, etc.).

In another embodiment, which may be referred to as "Program Music," and which may be combined with any other embodiment herein, computer architecture 100 is configured to proactively change a musical selection or musical parameters to match a workout program based on user-defined mappings between music and the workout program. For example, computer architecture 100 may receive user mappings between musical parameters and segments of a workout routine (e.g., a geographical workout route). For example, the user may choose musical parameters which cause computer system 100 to play a faster song (or increase the BPM/tempo of the current song) during more intense portions of the workout routine (e.g., while climbing a hill) and to play a slower song (or decrease the BPM/tempo of the current song) during less intense portions of the workout routine (e.g., while traversing a flat area or while descending a hill).

In another embodiment, which may be referred to as "Program Music Smart," and which may be combined with any other embodiment herein, computer architecture 100 is configured to combine pulse and music controls with workout programming. For example, computer architecture 100 may change or alter music in a manner that motivates a user to place his or her heart rate within a correct zone, and/or may change or alter music in a manner that follows a workout route or routine.

As depicted, computer architecture 100 includes display component 102, audio component 104, control component 106, communications component 108, and storage component 110. Each of the depicted components may be software components, or may be hardware component that are locally connected (e.g., as part of a system bus), or remotely connected through a hard-wired or wireless network.

Display component 102 is configured to present any appropriate workout-related data or user interfaces to a user. For example, display component 102 may present biometric data (e.g., pulse rate, metabolic rate, calories burned, etc.), workout performance data (e.g., speed, power, grade, etc.), a workout route or routine (or a segment thereof), a current location within a route, music data (e.g., current song, current BPM/tempo, current genre, etc.), and the like. Display component 102 can comprise any appropriate display technology, such as liquid crystal display (LCD), cathode ray tube (CRT), light-emitting diode (LED), active-matrix organic light-emitting diode (AMOLED), organic light-emitting diode (OLED), etc. In some embodiments, the foregoing data (or a portion thereof) may be presented audibly.

Audio component 104 is configured to provide an audio rendering for audio output. For example audio component 104, may comprise a software or hardware component which renders a chosen song, and/or which changes audio characteristics of a chosen song. For example, audio component 104 may be configured to alter the BPM and/or tempo of a song being rendered to encourage a user to perform at a different rate of exertion.

Communications component 108 is configured to communicate with appropriate devices to send and receive data related to a user's workout, and storage component 110 is configured to store any appropriate data, such as data received from communications component 108. As depicted, communications component 108 can include a plurality of software modules and/or devices. While these modules/devices are depicted separately, one will appreciate that some or all of these modules/devices may be combined. For example, some of these modules/devices may be embodied as in the form of USB, BLUETOOOTH, WiFi, IrDA, THUNDERBOLT, FIREWIRE, SECURE DIGITAL, ETHERNET, etc.

Route transfer module 108*a* is configured to communicate with other computer systems to send and/or receive geographical routes. For example, route transfer module 108*a* may receive a geographical workout route, along with mappings to that geographical workout route. As depicted, for example, storage component 110 can store a variety of data that can be received via route transfer module 108*a*, including one or more routes, target workout performance data (e.g., speed, grade, power generation, cadence) which may be mapped to a route, and target biometric data (e.g., pulse rate, metabolic rate, etc.) which may be mapped to a route.

Biometrics module 108*b* is configured to receive real-time biometric data for a user. For example, biometrics module 108*b* may interface with a heart rate (pulse) sensor, a blood oxygen sensor, a thermometer, or any other appropriate physiological sensor.

Audio module 108*c* is configured to audibly render audio data or to send audio data to an audio device. For example, audio module 108*c* may comprise a built-in speaker, a headphone jack, a BLUETOOTH radio, or other audio communications mechanism.

Route performance module 108*d* is configured to gather route performance data. For example, route performance module 108*d* may gather sensor data, such as GPS location, speed, grade, power generation, cadence, etc.

Hardware control module 108*e* is configured to control exercise hardware. For example, hardware control module 108*e* may be capable of instructing a workout device to adjust speed, grade, resistance, etc.

Music transfer module 108*f* is configured to receive music and/or the identity of music that can be associated with geographical routes. For example, music transfer module 108*f* may receive appropriate digital files (e.g., MP3, AAC, WMA, etc.) and/or appropriate metadata. Additionally or alternatively, music transfer module 108*d* may receive the identity of radio stations (e.g., AM, FM, Internet).

Control component 106 is configured to receive and analyze appropriate data (e.g., route data, biometric data, workout performance data, etc.) and to alter routes, music, and/or display data to help a user to achieve target biometric and/or performance parameters. For example, control component 106 may receive data from communications component 108 and/or storage component 110 and, based on user preferences, a mode of operation, and/or route mappings, modify routes, music, and/or display data as appropriate to help motivate the user and help the user achieve fitness goals.

Figure 2:
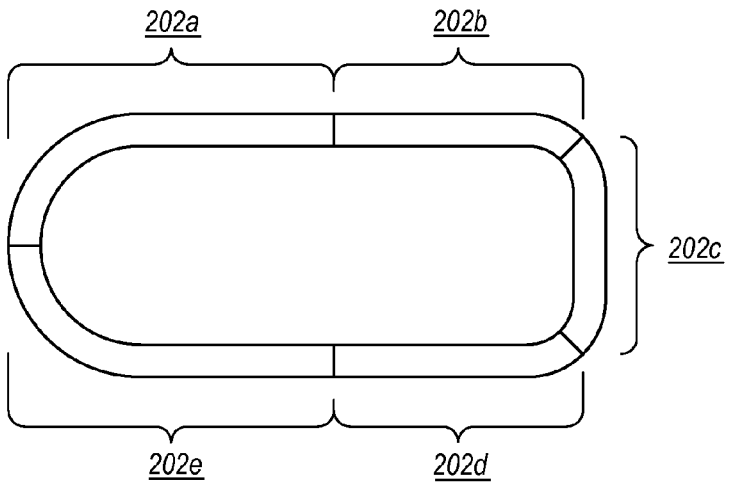
FIG. 2 illustrates geographical route mappings according to one example embodiment of the present disclosure.
Figure 2:
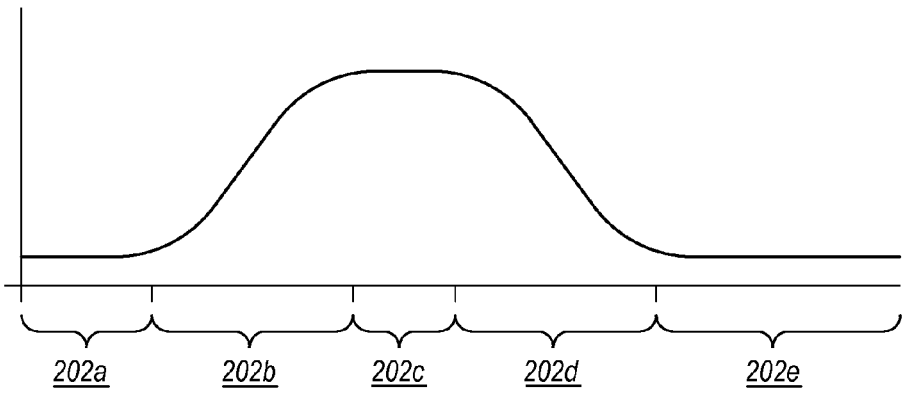

As discussed, computer architecture 100 can be used to motivate a user through music appropriately rendered during segments of a workout route. FIG. 2 illustrates an exemplary geographical route 200*b* and mappings 200*a* corresponding to the geographical route, according to one example embodiment of the present disclosure. FIG. 2 also depicts an exemplary elevation profile 200*c* corresponding to geographical route 200*b*. As depicted, exemplary geographical route 200*b* includes a plurality of route segments, 202*a*-202*e*. Geographical route 200*b* may comprise a physical geographical route, such as a route that is generated via user input at mapping software or a route that was recorded by a fitness device during a workout, or may comprise a fictional route modeled at a computer system.

The depicted geographical route 200*b* may correspond to a loop-type route that starts at the bottom of a hill (real or simulated), climbs the hill, traverse some distance at the top of the hill, and then descends the hill to arrive back at the starting point. As such, segment 202*a* may comprise a relatively level (i.e. a generally 0% grade) portion that is traversed prior to climbing the hill (e.g., a 4% grade), segment 202*b* may comprise a hill climbing portion, segment 202*c* may comprise a relatively level (i.e. a generally 0% grade) portion that is traversed at the top of the hill, segment 202*d* may comprise a hill descending portion (e.g., a −4% grade), and segment 202*e* may comprise a relatively level (i.e. a generally 0% grade) portion that is traversed after climbing the hill to return to the starting point.

Exemplary mappings 200*a* illustrate that various types of data may be mapped to geographical route 200*b*. For example, mappings 200*a* indicate that during segment 202*a*, a user desires to traverse segment 202*a* at 8 MPH and maintain a pulse rate of 120 BPM. In addition, the user desires to listen to "song 1," which is 60 BPM by default. Similarly, mappings 200*a* indicate that during segment 202*b*, the user desires to traverse segment 202*b* at 5 MPH and maintain a pulse rate of 160 BPM while listening to "song 1" at 80 BPM. Similar mappings exist for the other segments of route 200*b*. It will be appreciated that mappings 200*a* can include any appropriate mappings to target performance, target biometrics, music parameters, or any other appropriate types of data. For example, music parameters may indicate any combination of rhythm, BPM, tempo, particular songs, playlists, genres, Internet radio stations, etc.

Any data depicted in FIG. 2 may be made available to computer architecture 100 via route transfer module 108*a*, and may be stored at storage component 110 (e.g., as routes, music parameter data, target workout performance data, target biometric data, etc.). As such, control component 106 can analyze, in real-time, a user's performance of route 200*b* (e.g., via biometrics module 108*b*, route performance module 108*d*), whether the route 200*b* be physical or simulated. Control component 106 can provide appropriate audio renderings via audio component 104 and audio module 108*c* to motivate the user in accordance with mappings 200*a*, and may even modify audio renderings and/or control parameters of fitness hardware to help the user achieve target biometrics and/or workout performance.

Figure 3:
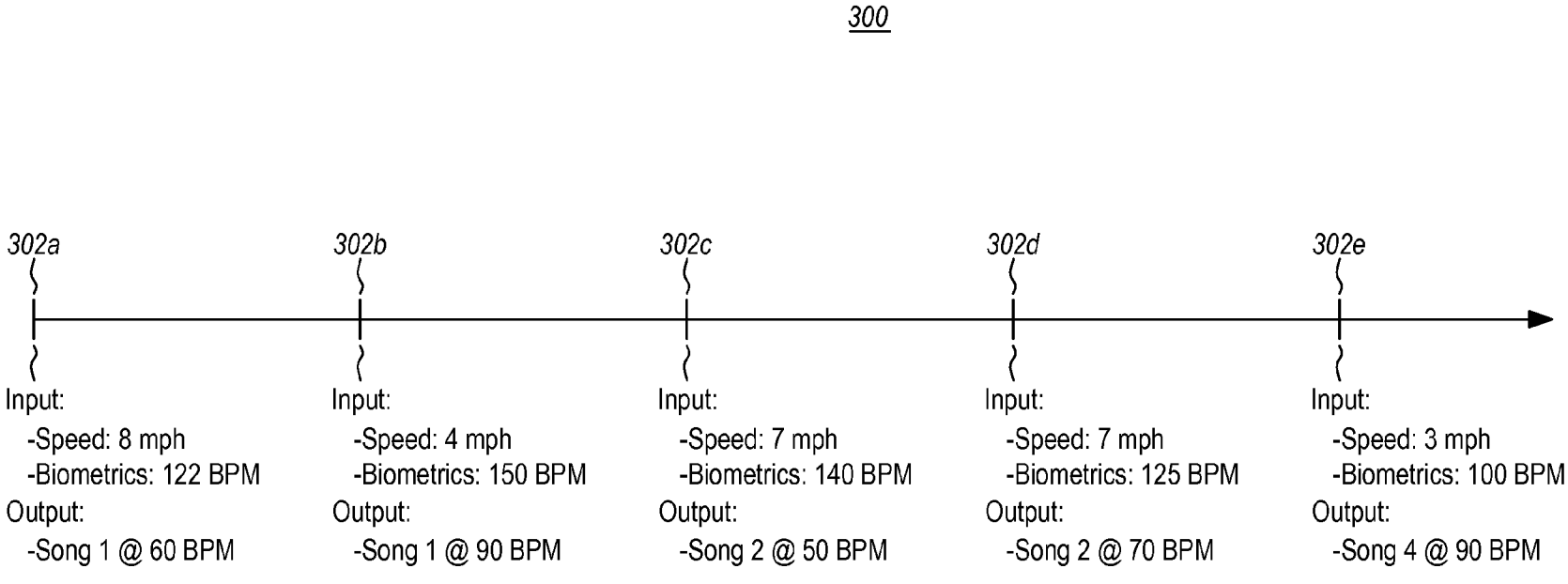
FIG. 3 illustrates a timing diagram for encouraging physical fitness through music according to one example embodiment of the present disclosure.

For example, FIG. 3 illustrates an exemplary diagram 300 illustrating performance of geographical route 200*b*. For example, diagram 300 may represent input received by computer architecture 100 and output generated by computer architecture 100 while a user runs geographical route 200*a* outdoors, or runs geographical route 200*a* in a simulated manner on a treadmill. Diagram 300 may correspond to time, distance, or any other appropriate unit of measure.

From point 302*a* to point 302*b*, the user may be performing segment 202*a* of route 200*a* (e.g., a generally level segment). For example, point 302*a* may represent the time at which the user begins segment 202*a* and point 302*b* may represent the time at which the user finishes segment 202*a*. Alternatively, point 302*a* may represent a geographical distance traversed by user at commencement of segment 202*a*, and point 302*b* may represent a geographical distance traversed by the user upon completion of segment 202*a*. As indicated, during segment 202*a* control component 106 may receive input indicating that the user is performing segment 202*a* at 8 MPH and has a pulse of 122 BPM. Since this is close to the target performance (8 MPH) and target biometrics (120 BPM), control component 106 can cause audio component 104 to render "song 1" at its normal speed (60 BPM), as planned.

From point 302*b* to point 302*c*, the user may be performing segment 202*b* of route 200*a* (e.g., a hill climb). As indicated, during segment 202*b* control component 106 may receive input indicating that the user is performing segment 202*b* at 4 MPH and has a pulse of 150 BPM. Since this is less than the target performance (5 MPH) and target biometrics (160 BPM), control component 106 can cause audio component 104 to render "song 1" at a higher speed (90 BPM), than was planned (80 BPM).

From point 302*c* to point 302*d*, the user may be performing segment 202*c* of route 200*a* (e.g., a level segment after a hill climb). As indicated, during segment 202*c* control component 106 may receive input indicating that the user is performing segment 202*c* at 7 MPH and has a pulse of 140 BPM. Since the user's heart rate is greater than the target biometrics (130 BPM), control component 106 can cause audio component 104 to render "song 2" at a lower speed (50 BPM) than was planned.

From point 302*d* to point 302*e*, the user may be performing segment 202*d* of route 200*a* (e.g., a descending a hill). As indicated, during segment 202*d* control component 106 may receive input indicating that the user is performing segment 202*d* at 7 MPH and has a pulse of 125 BPM. Since the user's heart rate is lower than the target biometrics (130 BPM), control component 106 can cause audio component 104 to render "song 2" at a higher speed (70 BPM) than was planned.

From point 302*e* to the end of the workout, the user may be performing segment 202*e* of route 200*a* (e.g., a level portion after descending a hill). As indicated, during segment 202*e* control component 106 may receive input indicating that the user is performing segment 202*e* at 3 MPH and has a pulse of 100 BPM. Since the user's heart rate is far lower than the target biometrics (120 BPM), control component 106 can cause audio component 104 to render a completely different song ("song 4") having a higher BPM (90 BPM) than the planned song (i.e., "song 3" at 60 BPM).

As illustrated by FIG. 3, computer architecture 100 can use alterations to rendered audio to help a user achieve performance and/or biometric targets specified in mappings between route segments and target metrics. In addition, computer architecture 100 may change the route itself. For example if route 200*a* were being simulated on an indoor fitness device, control component 106 may use hardware control module 108*e* to alter parameters (e.g., speed, incline, resistance, etc.) of the fitness device to further influence the user's performance. For example, if the user's pulse is too low, the control component 106 may increase the speed or incline of a treadmill. Conversely, if the user's pulse is too high, the control component 106 may decrease the speed or incline of the treadmill.

Computer architecture 100 can be configured to make changes in rendered audio and/or hardware controls in real-time and as often as needed to motivate user performance. As such, control component 106 may make multiple changes to audio and/or hardware controls during performance of a single segment. In addition, computer architecture 100 can be configured to make changes in rendered audio and/or hardware controls related to a route segment whether or not the user is presently performing the segment. For example, control component 106 may preemptively present an audio rendering or modify hardware controls prior to the user actually performing a segment in order to help prepare the user for performance of the segment. As such, control component 106 may present/modify an audio rendering or modify hardware controls as the user approaches a segment (in time or geographical space) in addition or as an alternative to presenting/modifying an audio rendering or modifying hardware controls during performance of a route segment.

FIGS. 2 and 3 have presented embodiments in which music parameters are mapped to specific segments of a workout route. However, some embodiments map musical parameters to geography absent specific segments. As such, these mappings can be used for any geographical route, as long as computer architecture 100 can detect geographical characteristics of the route being performed by the user (using route performance module 108*d*, for example). For example, exemplary mappings may specify that, while a user works out on relatively flat geography, computer architecture 100 should render music at a particular BPM or tempo (or at a particular BPM/tempo range). The exemplary mappings may also specify that, while the user works out on other types of geography, computer architecture 100 should render music at a different BPM or tempo (or at a different BPM/tempo range). For example, the exemplary mappings may specify that the BPM/tempo should increase 10% for each percentage of grade increase, or should decrease 10% for each percentage of grade decrease. Any mappings between musical parameters and geography are possible. Geographical characteristics may include, for example, grade/include, elevation, terrain type (e.g., pavement, road, trail, etc).

Figure 4:
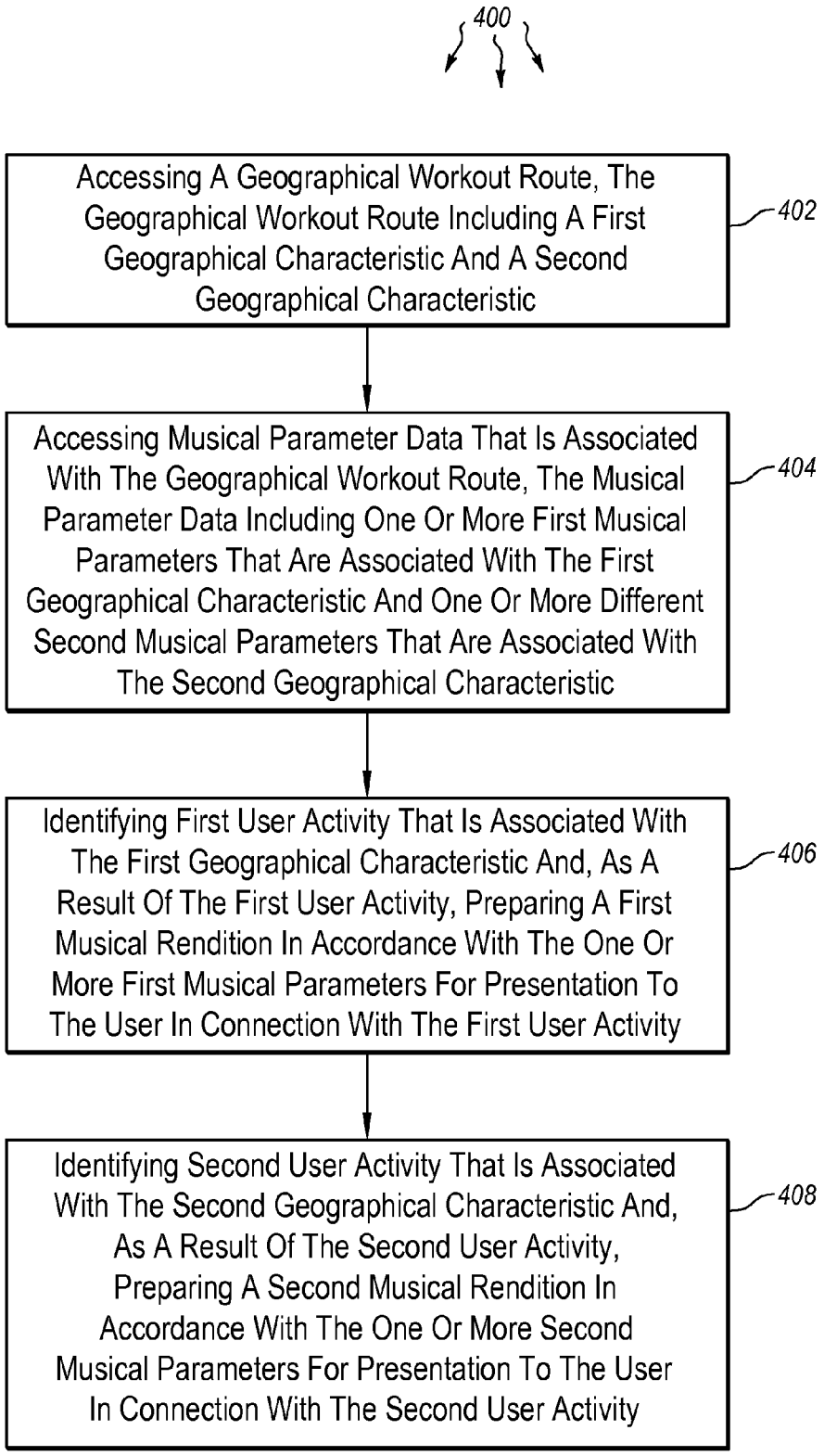
FIG. 4 illustrates a flowchart of an example method for motivating physical performance through music according to one example embodiment of the present disclosure.

Embodiments of the present disclosure may be described in the context of acts in computer-implemented methods. FIG. 4, for example, illustrates a flow chart of an example method 400 for motivating physical performance through music. Method 400 will be described with respect to the components and data of computer architecture 100.

Method 400 includes an act of accessing a geographical workout route, the geographical workout route including a first geographical characteristic and a second geographical characteristic (act 402). For example, control component 106 can access a geographical workout route, either from storage component 110 or using route transfer module 108*a*. Control component 106 may access a simulated route, or a route representing a physical geographical route. The route may include a plurality of geographical characteristics. In some embodiments, the route may include a plural of expressly defined route segments (as in FIGS. 2 and 3) that correspond with geographical features, and/or time features. For example, route segments may represent different areas of geographical difficulty during the route, or may divide the route into different time segments. In other embodiments, the route may simply include a plurality of geographical characteristics (e.g. grade/include, terrain type).

Method 400 also includes an act of accessing musical parameter data that is associated with the geographical workout route, the musical parameter data including one or more first musical parameters that are associated with the first geographical characteristic and one or more different second musical parameters that are associated with the second geographical characteristic (act 404). For example, control component 106 can access musical parameter data, either from storage component 110 or using communications component 108 (e.g., route transfer module 108*a*). The musical parameter data can specify any number of parameters that are associated with geographical characteristics, such as song, artist, genre, playlist, station, tempo, BPM, rhythm, etc. For example, FIG. 2 illustrates that segment 202*a* of an exemplary route may be associated with "song 1" at 60 BPM (as the user traverses a flat area) and segment 202*b* of the exemplary route may be associated with "song 1" at 80 BPM (as the user climbs a hill). In another example, the musical parameter data may specify that during level periods in the route songs should be played at 60 BPM, and that the BPM or tempo of the songs should be increased/decreased 10% with each percentage of grade increase/decrease.

Method 400 also includes an act of identifying first user activity that is associated with the first geographical characteristic and, as a result of the first user activity, preparing a first musical rendition in accordance with the one or more first musical parameters for presentation to the user in connection with the first user activity (act 406). For example, using route performance module 108*d*, control component 106 can detect that a user is approaching or performing segment 202*a* of route 200*a*, or can detect that the user is approaching or performing a level portion of the route. If route 200*a* is being performed outdoors, performance module 108*d* may detect a GPS location of the user, or may use a clock to detect how long the user has been performing the segment. If the route is being performed indoors on a stationary device, performance module 108*d* may gain knowledge of the user's performance through simulation of the route. As a result of the user approaching or performing segment 202*a*, or approaching or performing a level portion of the route, control component 106 can cause audio component 104 to render "song 1" at 60 BPM.

Method 400 also includes an act of identifying second user activity associated with the second geographical characteristic and, as a result of the second user activity, preparing a second musical rendition in accordance with the one or more second musical parameters for presentation to the user in connection with the second user (act 408). For example, using route performance module 108*d*, control component 106 can detect that a user is approaching or performing segment 202*b* of route 200*a*, or that the user is approaching or performing a portion of the route having a positive grade. As a result of the user approaching or performing segment 202*a*, or approaching or performing the positive grade, control component 106 can cause audio component 104 to render "song 1" at 80 BPM (or another defined increase in BPM/tempo), to motivate the user during a hill climb.

While not depicted, method 400 can also include rendering audio configured to motivate the user to achieve target biometrics and/or performance metrics when the user is not meeting those metrics. Method 400 can also include using hardware control 108*e* to change parameters (e.g., speed, incline) of a stationary workout device to help the user achieve the metrics.

Figure 5:
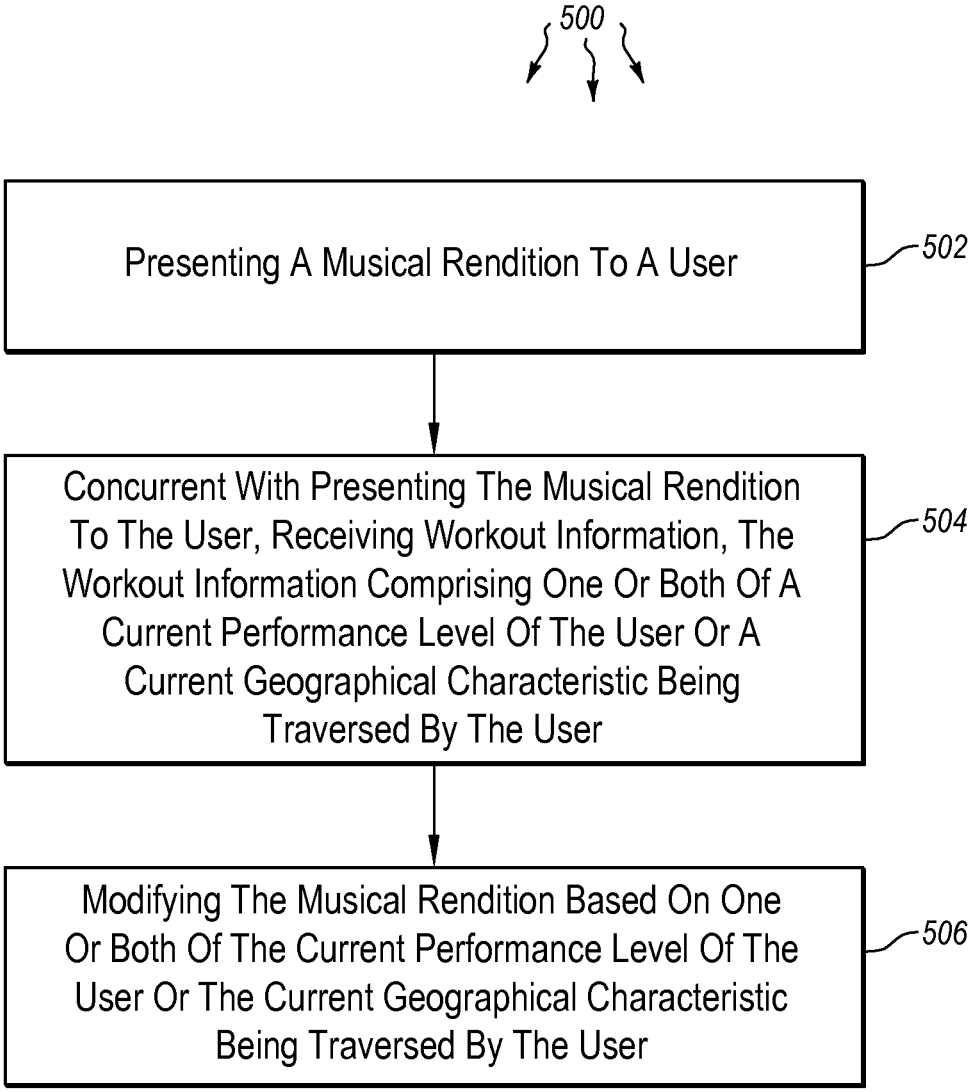
FIG. 5 illustrates a flowchart of an example method for motivating physical performance through music according to one example embodiment of the present disclosure

While FIGS. 2-4 describe embodiments in which computer architecture 100 maps music parameters to geography, computer architecture 100 is also usable apart from such mappings. FIG. 5, for example, illustrates a flow chart of an example method 500 for motivating physical performance through music, in which the motivation comes through music reactively changing with the user's performance. For example, as the user's speed slows, the BPM of rendered music may also slow, signaling the user that his or her performance may be suffering. Alternatively, when the user's speed slows, the BPM of the rendered music may increase, signaling the user that his or her performance is improving. Method 500 will be described with respect to the components and data of computer architecture 100.

Method 500 includes an act of presenting a musical rendition to a user (act 502). For example, audio component 104 can render a song for a user. The song can have particular musical characteristics, such as a particular BPM, a particular tempo, etc.

Method 500 also includes an act of, concurrent with presenting the musical rendition to the user, receiving workout information, the workout information comprising one or both of a current performance level of the user or a current geographical characteristic being traversed by the user (act 504). For example, route performance module 108*d* can receive real-time information about the workout presently being performed. That information can include speed, grade, power generation, cadence, etc.

Method 500 also includes an act of modifying the musical rendition based on one or both of the current performance level of the user or the current geographical characteristic being traversed by the user (act 506). For example, control component 106 can determine, based on the real-time information about the workout, that the current performance level (e.g., speed, power generation, cadence) or current geographical characteristic (e.g., grade, terrain type, etc.) indicates a change in user performance and/or geography. For example, the user's speed may be changing (e.g., slowing down or speeding up) and/or the grade the user is traversing may be changing. To motivate the user, control component 106 can alter the audio being rendered for the user. For example, control component 106 may cause audio component 104 to render a different song, or to change the musical characteristics of the song being played. For example, if the user is slowing down, the BPM of the song may also decrease—signaling the user the he or she is going slower. Conversely, if the user is speeding up, the BPM of the song may also increase—signaling the user that he or she is going faster. Similar audio adjustments can be made to indicate changes in grade, power generation, etc.

Figure 6:
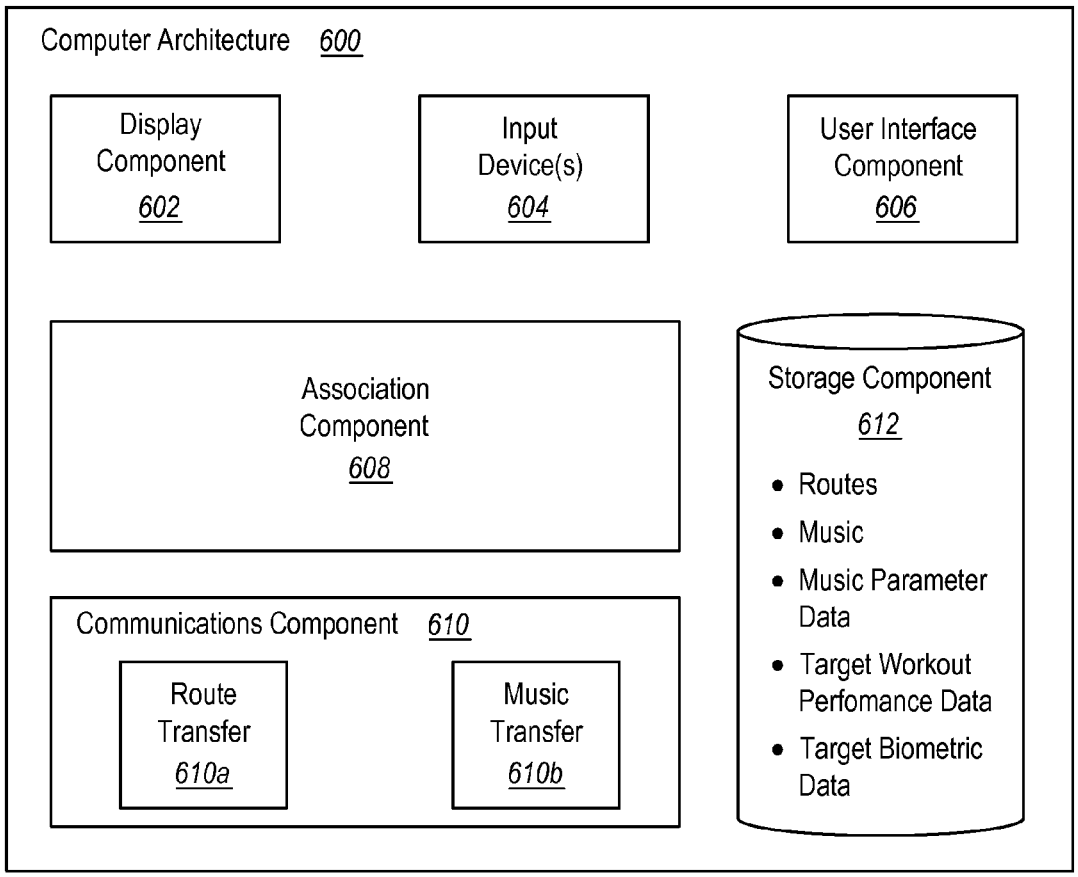
FIG. 6 illustrates a computer architecture for associating music with a geographic route according to one example embodiment of the present disclosure.

Depicted in FIG. 6 is a computer architecture 600 for mapping music, performance parameters, and the like to a geographical route. As depicted, computer architecture 600 includes display component 602, input device(s) 604, user interface component 606, association component 608, communications component 610, and storage component 612. Each of the depicted components may be software components, or may be hardware component that are locally connected (e.g., as part of a system bus), or remotely connected through a hard-wired or wireless network. In some embodiments, computer architecture 600 may be combined with computer architecture 100. As such, a single device may be used both to map parameters to a geographical route and to use those mappings to motivate a user while the user is performing a workout.

Display component 602 is configured to present any appropriate data or user interfaces to a user. Display component 602 can comprise any appropriate display hardware, such as LCD, CRT, LED, AMOLED, OLED, etc. User interface component 606 is configured to generate user interfaces for display at display component 602. For example, display component 602/user interface component 606 may be used to present one or more user interfaces for mapping parameters to geographical routes. For example, user interface component 606 may generate, and display component 602 may display, the user interfaces depicted in FIGS. 7 and 8.

Input device(s) 604 are configured to receive user input relevant to user interfaces generated by user interface component 606 and displayed by display component 602. For example, input device(s) 604 may comprise buttons, switches, keyboard device(s), pointing device(s), touch-sensitive device(s), etc.

Association component 608 is configured to associate/map various data to geographical routes. For example, association component 608 may associate different musical parameters (e.g., song, genre, artist, tempo, BPM, etc.) to different segments of a geographical route. In addition, association component 608 may associate target workout performance data and/or target biometric data to different segments of geographical routes. Association component 608 can associate data to routes based on user input received at input device(s) 604 in connection with user interfaces generated by user interface component 606 and displayed by display component 602. Association component 608 can store associations/mappings in storage component 612.

Communications component 610 is configured to communicate with appropriate devices to send and receive route and mapping data, and storage component 612 is configured to store any appropriate data. As depicted, communications component 610 includes a plurality of software modules and/or devices. While these modules/devices are depicted separately, one will appreciate that some or all of these modules/devices may be combined. For example, some of these modules/devices may be embodied as in the form of USB, BLUETOOOTH, WiFi, IrDA, THUNDERBOLT, FIREWIRE, SECURE DIGITAL, ETHERNET, etc.

Route transfer module 610*a* is configured to communicate with other computer systems to send and/or receive geographical routes. For example, route transfer module 610*a* may receive a geographical workout route having a plurality of route segments. Route transfer module 610*a* may also send a geographical route (along with mappings) to workout devices, such as devices that include computer architecture 100.

Music transfer module 610*b* is configured to receive music and/or the identity of music that can be associated with geographical routes. For example, music transfer module 610*b* may receive appropriate digital files (e.g., MP3, AAC, WMA, etc.) and/or appropriate metadata. Additionally or alternatively, music transfer module 610*b* may receive the identity of radio stations (e.g., AM, FM, Internet). Music transfer module 610*b* may send music to workout devices, such as such as devices that include computer architecture 100.

Storage component 612 is configured store a variety of data that can be received via communications component 610, including geographical routes, music, music parameter data (e.g., BPM/tempo data) which may be mapped to a route, etc.

Figure 7:
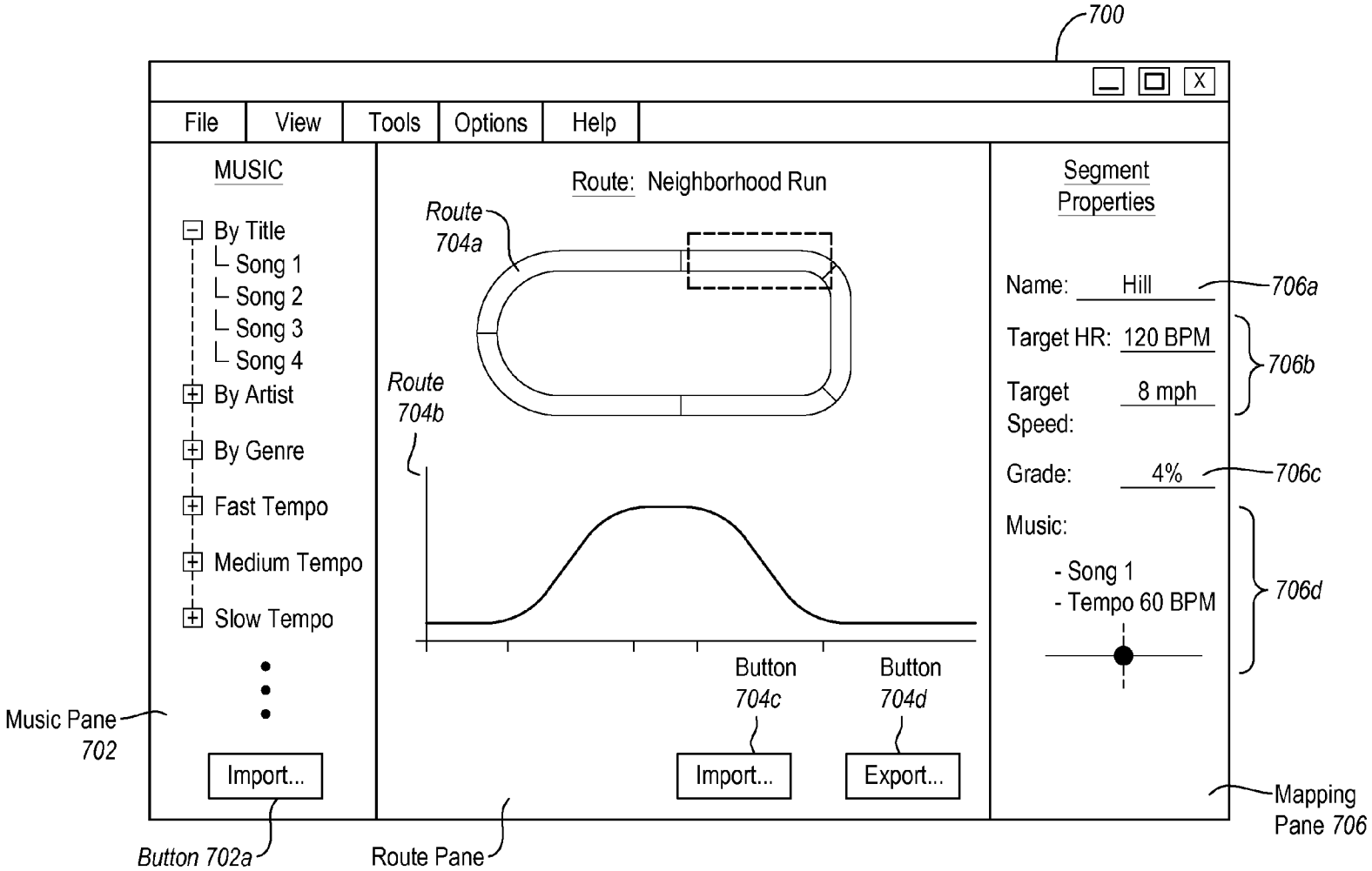
FIG. 7 illustrates a user interface for associating music with a geographic route according to one example embodiment of the present disclosure.
Figure 8:
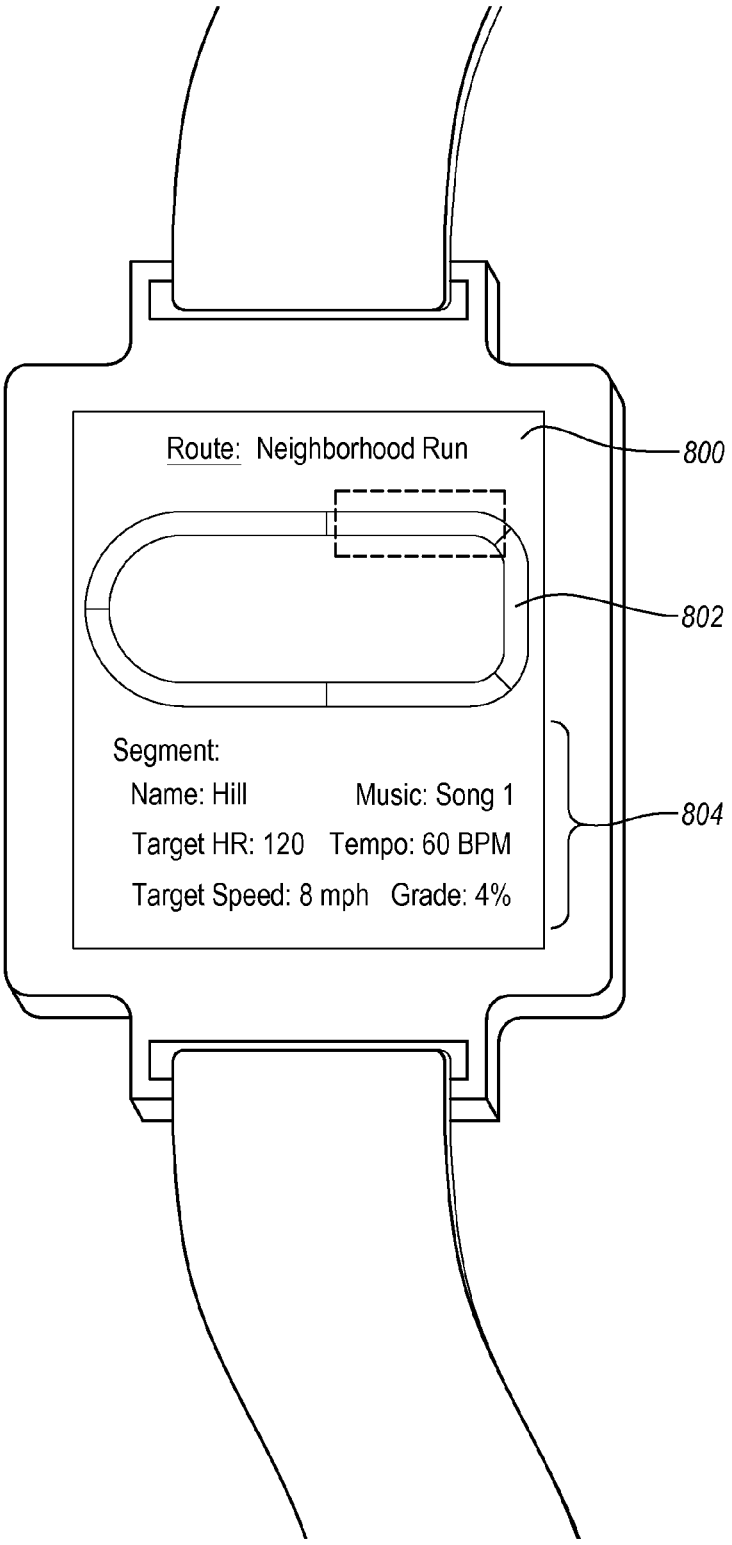
FIG. 8 illustrates a user interface for associating music with a geographic route according to one example embodiment of the present disclosure.

Embodiments of the invention can also be described in the context of user interfaces. Such user interfaces may be generated by user interface component 606 and displayed by display component 602. For example, FIG. 7 illustrates an example desktop user interface 700 for mapping data to geographical routes, and FIG. 8 illustrates an example mobile user interface 800 for mapping data to geographical routes. One will appreciate that that functionally provided by user interfaces 700, 800 can be embodied in a variety of forms, and that the present invention is not limited to the depicted user interfaces.

As depicted, user interface 700 can include a plurality of functional display areas, such as music pane 702, route pane 704, and mapping pane 706. Music pane 702 presents available music for mapping with a geographical route. For example, FIG. 7 depicts that music pane 702 may present musical selections in a hierarchical format that may include categories, sub-categories, and leaf items. For example, FIG. 7 depicts categories including songs "By Title" (including songs 1-4), songs "By Artist," songs "By Genre," and songs by speed (e.g., "Fast Tempo," "Medium Tempo," and "Slow Tempo"). FIG. 7 also depicts that user interface 700 may include functionality for obtaining additional music, such as button 702*a* (Import).

Route pane 704 presents a geographical route and enables a user to define and/or select different segments of the route. For example, FIG. 7 depicts that route pane 704 may present route 704*a* and elevation profile 704*b*, which may correspond to geographical route 200*b* and elevation profile 200*c*. As depicted by the dashed box, a segment (e.g., segment 220*b*) of route 704*a* is selected for mapping. In some embodiments, route pane 704 presents a physical geographical route that was recorded with a geo-location device. In some embodiments, route pane 704 enables the user to generate or create a geographical route (real or simulated) from scratch. FIG. 7 also depicts that user interface 700 may include functionality for obtaining additional routes and for exporting routes (and their mappings), such as button 704*c* (Import) and button 704*d* (Export).

Mapping pane 706 enables a user to associate different route segments with different parameters. For example, FIG. 7 depicts that mapping pane 706 may present a route identifier 706*a* and route information 706*c* (e.g., distance, grade, etc.), and enable the user to enter target parameters 706*b* (e.g., performance and/or biometric parameters). In addition, mapping pane 706 enables the user to apply target music parameters 706*d*, such as a desired song, genre, etc., and any modifications to the selected song, genre, etc. (e.g., a desired BPM or tempo). For example, mapping pane 706 includes a slider control that enables the user to change the song's tempo.

User interface 800 of FIG. 8 presents similar functionality on a mobile fitness device. For example, FIG. 8 depicts that user interface 800 presents a route 802 to a user, and enables the user to assign properties 804 to different segments of the route.

The user interfaces of FIGS. 7 and 8 can also map musical parameters to geographical characteristics generally. For example, instead of defining express route segments, a user may define different geographical characteristics (e.g., grade/incline, terrain type) and map different musical parameters to the terrain types generally. Then, whenever the terrain type is encountered during a workout, the musical parameters can be applied to the portion(s) of the workout having the terrain type.

Figure 9:
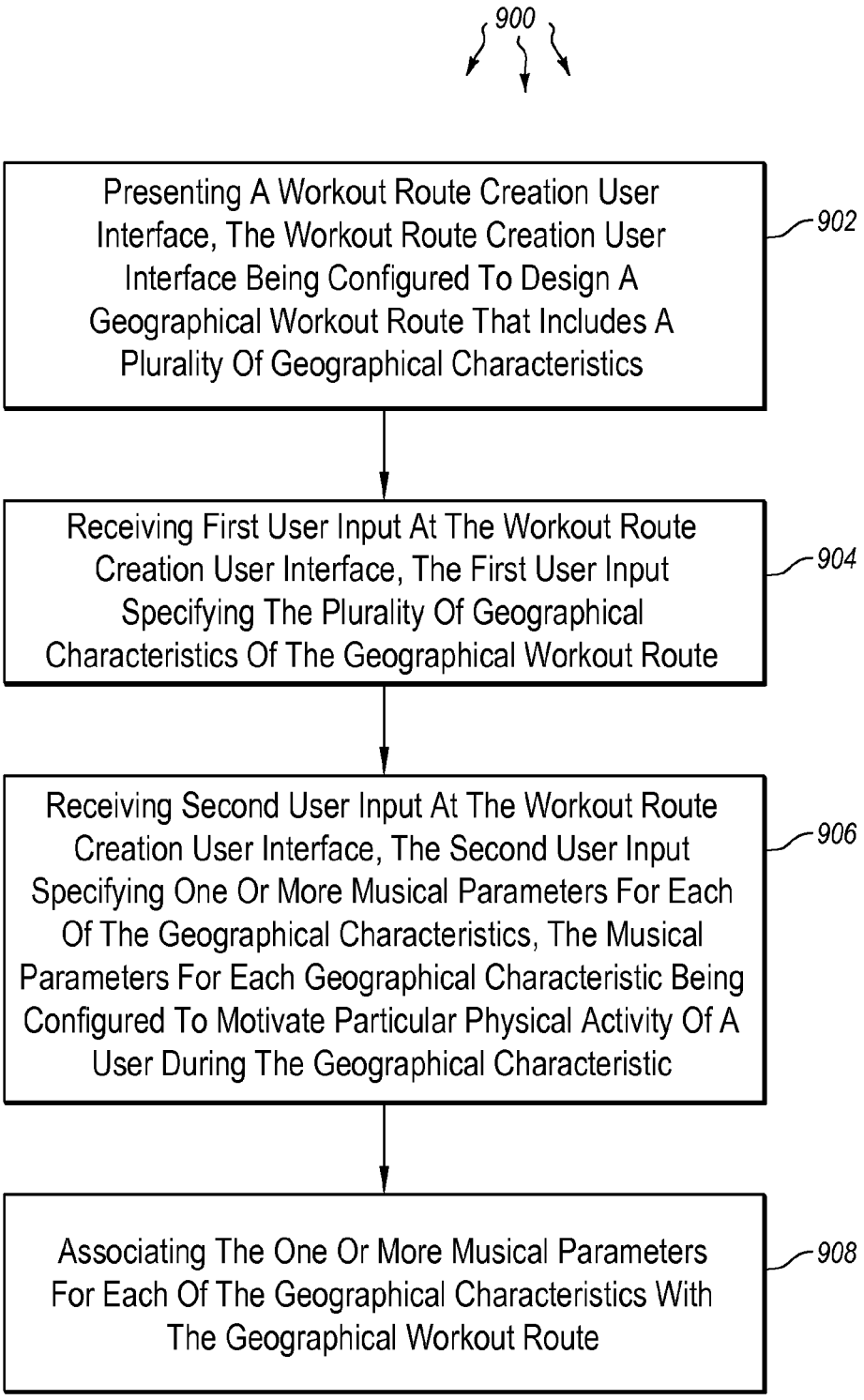
FIG. 9 illustrates a flowchart of an example method for designing a workout that motivates physical performance through music according to one example embodiment of the present disclosure.

FIG. 9 illustrates a flow chart of an example method 900 for designing a workout that motivates physical performance through music. Method 900 will be described with respect to the components and data of computer architecture 600 and user interfaces 700, 800.

Method 900 includes an act of presenting a workout route creation user interface, the workout route creation user interface being configured to design a geographical workout route that includes a plurality of geographical characteristics (act 902). For example, user interface component 606 can generate a user interface, such as user interface 700 or user interface 800, at display component 602. The displayed user interface can import an existing geographical route (real or simulated) or enable the user to create a route from scratch. Whether imported or created from scratch, the user can designate and/or select a plurality of route segments or define geographical characteristics (e.g., incline/grade, terrain type) absent express segments.

Method 900 also includes an act of receiving first user input at the workout route creation user interface, the first user input specifying the plurality of geographical characteristics of the geographical workout route (act 904). For example, the user may divide an imported geographical route into a plurality of segments, or the user may create a plurality of route segments from scratch when creating a route. In another example, the user may define different geographical characteristics absent express segments.

Method 900 also includes an act of receiving second user input at the workout route creation user interface, the second user input specifying one or more musical parameters for each of the geographical characteristics, the musical parameters for each geographical characteristic being configured to motivate particular physical activity of a user during the geographical characteristic (act 906). For example, the user may select each expressly defined route segment and apply one or more musical parameters to each segment, when selected. For example the user may specify a song, genre, song speed (e.g., fast, slow, medium), etc. for each route segment, as well as customized parameters (e.g., BPM, tempo) for each segment. In another example, the user may specify that different types of geographical characteristics (e.g., grade, terrain type) are associated with different musical parameters.

Method 900 also includes an act of associating the one or more musical parameters for each of the geographical characteristics with the geographical workout route (act 908). For example, association component 608 can associate/map the specified musical parameters with each defined geographical characteristic. These associations can be stored in storage component 612, and/or exported to a workout device using communications component 610.

Embodiments of the present disclosure may comprise or utilize a special purpose or general-purpose computer including computer hardware, such as, for example, one or more processors and system memory, as discussed in greater detail below. Embodiments within the scope of the present disclosure also include physical and other computer-readable media for carrying or storing computer-executable instructions and/or data structures. Such computer-readable media can be any available media that can be accessed by a general purpose or special purpose computer system. Computer-readable media that store computer-executable instructions are computer storage media (devices). Computer-readable media that carry computer-executable instructions are transmission media. Thus, by way of example, and not limitation, embodiments can comprise at least two distinctly different kinds of computer-readable media: computer storage media (devices) and transmission media.

Computer storage media (devices) includes RAM, ROM, EEPROM, CD-ROM, solid state drives ("SSDs") (e.g., based on RAM), flash memory, phase-change memory ("PCM"), other types of memory, other optical disk storage, magnetic disk storage or other magnetic storage devices, or any other medium which can be used to store desired program code means in the form of computer-executable instructions or data structures and which can be accessed by a general purpose or special purpose computer.

A "network" is defined as one or more data links that enable the transport of electronic data between computer systems and/or modules and/or other electronic devices. When information is transferred or provided over a network or another communications connection (either hardwired, wireless, or a combination of hardwired or wireless) to a computer, the computer properly views the connection as a transmission medium. Transmissions media can include a network and/or data links which can be used to carry desired program code means in the form of computer-executable instructions or data structures and which can be accessed by a general purpose or special purpose computer. Combinations of the above should also be included within the scope of computer-readable media.

Further, upon reaching various computer system components, program code means in the form of computer-executable instructions or data structures can be transferred automatically from transmission media to computer storage media (devices) (or vice versa). For example, computer-executable instructions or data structures received over a network or data link can be buffered in RAM within a network interface module (e.g., a "NIC"), and then eventually transferred to computer system RAM and/or to less volatile computer storage media (devices) at a computer system. Thus, it should be understood that computer storage media (devices) can be included in computer system components that also (or even primarily) utilize transmission media.

Computer-executable instructions comprise, for example, instructions and data which, when executed at a processor, cause a general purpose computer, special purpose computer, or special purpose processing device to perform a certain function or group of functions. The computer executable instructions may be, for example, binaries, intermediate format instructions such as assembly language, or even source code. Although the subject matter has been described in language specific to structural features and/or methodological acts, it is to be understood that the subject matter defined in the appended claims is not necessarily limited to the described features or acts described above. Rather, the described features and acts are disclosed as example forms of implementing the claims.

Those skilled in the art will appreciate that the present disclosure may be practiced in network computing environments with many types of computer system configurations, including, personal computers, desktop computers, laptop computers, message processors, hand-held devices, multiprocessor systems, microprocessor-based or programmable consumer electronics, network PCs, minicomputers, mainframe computers, mobile telephones, PDAs, tablets, pagers, routers, switches, and the like. The present disclosure may also be practiced in distributed system environments where local and remote computer systems, which are linked (either by hardwired data links, wireless data links, or by a combination of hardwired and wireless data links) through a network, both perform tasks. In a distributed system environment, program modules may be located in both local and remote memory storage devices.

INDUSTRIAL APPLICABILITY

In general, the embodiments of the present disclosure relate to exercise systems, methods, and computer program products that motivate exercisers through music. Thus, the systems, methods, and computer program products of the present disclosure enable fitness device manufacturers to encourage users to achieve their fitness goals and to more thoroughly enjoy their workout experience.

By enabling a user to associate segments of his or her workout route (real or simulated) with different musical parameters, the user is able to introduce variety into their workout while providing timely and customized stimuli in the form of music. In addition, by using audio as a feedback mechanism, users are able to gauge (and modify) their workout performance in a simple, intuitive manner. As such, the systems, methods, and computer program products benefit users by providing a rich workout experience, along with increased rewards in terms of physical fitness improvement.

The systems, methods, and computer program products benefit device manufacturers by enabling manufacturers to provide compelling devices that enable users to get the most out of their workouts. The embodiments described herein provide manufacturers compelling features in their devices that can help drive sales.

For example, using the systems, methods, and computer program products of the present disclosure, a treadmill manufacturer may tie music to the incline of the treadmill. The incline may change in response to a user command, or in response to a workout route. The workout route may be simulating real-world terrain, or may be varied based on a generic workout program. Regardless of the cause of the incline change, the BPM/tempo of music being played to a user may change to motivate the user during the particular incline.

In another example, using the systems, methods, and computer program products of the present disclosure, a mobile device or application manufacturer may configure a mobile device to track a predefined real-world route that a user will traverse (e.g., run, cycle, etc.). As the user traverses different portions of the route, the BPM/tempo of music being played to the user may change to match the portion. For example, music parameters may be defined for express segments of the route, or for general geographical characteristics of the route. As the user traverses a corresponding segment or geographical characteristic, music being played can be modified to motivate the user during the segment or geographical characteristic.

In yet another example, a mobile device or application manufacturer may configure a device to modify music based on geographical characteristics absent a predefined route. For example, a user may map musical parameters to geographical characteristics, and as the user traverses like characteristics (regardless of the route), the BPM/tempo of music being played to the user may change to motivate the user.

What is claimed is:

1. A method, implemented at a computer system that includes one or more processors, for motivating physical performance through music, the method comprising acts of:

the computer system accessing a simulated geographical workout route, the simulated geographical workout route including a first geographical characteristic and a second geographical characteristic;

the computer system accessing musical parameter data that is associated with the geographical workout route, the musical parameter data including one or more first musical parameters that are associated with the first geographical characteristic and one or more different second musical parameters that are associated with the second geographical characteristic;

the computer system identifying first user activity that is associated with the first geographical characteristic and, as a result of the first user activity, preparing a first musical rendition in accordance with the one or more first musical parameters for presentation to the user in connection with the first user activity;

the computer system identifying second user activity that is associated with the second geographical characteristic and, as a result of the second user activity, preparing a second musical rendition in accordance with the one or more second musical parameters for presentation to the user in connection with the second user activity;

the computer system receiving biometric data of the user, the user biometric data including one or more biometric parameters representing a physiological state of the user during the first user activity;

the computer system determining that the one or more biometric parameters of the user during the first user activity do not conform to one or more first target biometric parameters; and the computer system modifying the simulated geographical workout route to encourage the user to achieve the target biometric parameters if the one or more biometric parameters of the user during the first user activity do not conform to the target biometric parameters.

2. The method as recited in claim 1, further comprising the computer system accessing target biometric data that is associated with the geographical workout route, the target biometric data including one or more first target biometric parameters that are associated with the first geographical characteristic and one or more different second target biometric parameters that are associated with the second geographical characteristic.

3. The method as recited in claim 2, further comprising:

the computer system modifying the first musical rendition, the modified first musical rendition being configured to motivate the user to achieve the target biometric parameters.

4. The method as recited in claim 3, wherein the one or more first musical parameters include a particular musical selection, the act of modifying the first musical rendition comprising modifying one or more of a beat or a tempo of the particular musical selection to motivate the user to achieve the target biometric parameters.

5. The method as recited in claim 3, wherein the one or more first musical parameters include a particular musical selection, the act of modifying the first musical rendition comprising selecting a different musical selection having a different beat or tempo than the particular musical selection to motivate the user to achieve the target biometric parameters.

6. The method as recited in claim 3, wherein the one or more first musical parameters include one or both of a desired beat or a desired tempo, and wherein:

the act of preparing the first musical rendition in accordance with the one or more first musical parameters for presentation to the user in connection with the first user activity comprises selecting a musical selection having one or both of the desired beat or the desired tempo, and the act of modifying the first musical rendition comprises modifying one or both of the beat or the tempo of the musical selection to motivate the user to achieve the target biometric parameters.

7. The method as recited in claim 1, further comprising the computer system receiving the simulated geographical workout route and the musical parameter data, one or both of the simulated geographical workout route or the musical parameter data being generated based on user input.

8. The method as recited in claim 1, wherein each of the one or more first musical parameters and the one or more second musical parameters include one or more of a particular musical selection, a beat, or a tempo, the acts of preparing the first musical rendition in accordance with the one or more first musical parameters for presentation to the user in connection with the first user activity and preparing the second musical rendition in accordance with the one or more second musical parameters for presentation to the user in connection with the second user activity comprising preparing each musical rendition based on one or more of the musical selection, beat, or tempo specified in the corresponding musical parameters.

9. The method as recited in claim 1, wherein the act of identifying user activity that is associated with a geographical characteristic comprises an act of identifying that the user is approaching a corresponding geographical characteristic during a workout.

10. The method as recited in claim 1, wherein the computer system modifies the simulated geographical workout route and the first musical rendition to encourage the user to achieve the target biometric parameters if the one or more biometric parameters of the user during the first user activity do not conform to the target biometric parameters.

11. The method as recited in claim 1, further comprising acts of:

the computer system audibly presenting the first musical rendition to the user during the first user activity; and the computer system audibly presenting the second musical rendition to the user during the second user activity.

12. The method as recited in claim 1, wherein when the computer system determines that the one or more biometric parameters of the user during the second user activity do not conform to target biometric parameters, modifies the second musical rendition, the modified second musical rendition being configured to motivate the user to achieve the target biometric parameters; and modifies the simulated geographical workout route, the modified simulated geographical workout route being configured to encourage the user to achieve the target biometric parameters.

13. The method as recited in claim 1, further comprising acts of:

the computer system accessing target route performance data that is associated with the geographical workout route, the target route performance data including a target speed that is associated with the first geographical characteristic, the computer system receiving user performance data, the user performance data including a current speed of the user during the first user activity;

the computer system determining that the current speed of the user during the first user activity does not conform to the target speed; and the computer system modifying the first musical rendition, the modified first musical rendition being configured to motivate the user to achieve the target speed.

14. The method as recited in claim 1, wherein the first geographical characteristic and the second geographical characteristic comprise expressly defined route segments.

15. The method as recited in claim 1, wherein the first geographical characteristic and the second geographical characteristic comprise one or more of a grade or a terrain type.

16. A method, implemented at a computer system that includes one or more processors, for designing a workout that motivates physical performance through music, the method comprising acts of:

the computer system presenting a workout route creation user interface, the workout route creation user interface being configured to design a geographical workout route that includes a plurality of geographical characteristics;

the computer system receiving first user input at the workout route creation user interface, the first user input specifying the plurality of geographical characteristics of the geographical workout route;

the computer system receiving second user input at the workout route creation user interface, the second user input specifying one or more musical parameters for each of the geographical characteristics, the musical parameters for each geographical characteristic being configured to motivate particular physical activity of a user during the geographical characteristic;

the computer system associating the one or more musical parameters for each of the geographical characteristics with the geographical workout route;

the computer system receiving biometric data about the user during the geographical workout route, the user biometric data including one or more biometric parameters representing a physiological state of the user during the geographical workout route;

the computer system determining that the one or more biometric parameters of the user during the geographical workout route do not conform to one or more target biometric parameters; and the computer system modifying the geographical workout route to encourage the user to achieve the target biometric parameters if the one or more biometric parameters of the user during the geographical workout route do not conform to the target biometric parameters.

17. The method as recited in claim 16, further comprising acts of:

the computer system receiving third user input at the workout route creation user interface, the third user input specifying one or more target biometric parameters for each geographical characteristic; and the computer system associating the one or more target biometric parameters for each of the geographical characteristics with the geographical workout route.

18. The method as recited in claim 16, wherein the second user input specifying one or more musical parameters for each of the geographical characteristics comprises user input specifying a particular song or playlist for each of the geographical characteristics.

19. The method as recited in claim 16, wherein the geographical workout route represents a simulated workout route.

20. A method, implemented at a computer system that includes one or more processors, for motivating physical performance through music, the method comprising acts of:

a computer system communicating with an exercise device, a user performing a workout on the exercise device;

the computer system presenting a musical rendition to the user;

concurrent with the computer system presenting the musical rendition to the user, the computer system receiving workout information of the user using the exercise device, the workout information comprising a current performance level of the user, a current geographical characteristic being traversed by the user, and biometric data about the user, the user biometric data including one or more biometric parameters representing the physiological state of the user during the workout;

the computer system modifying the musical rendition based on one or both of the current performance level of the user or the current geographical characteristic being traversed by the user;

the computer system determining that one or more biometric parameters of the user during the workout do not conform to one or more target biometric parameters; and the computer system modifying a degree of difficulty of the workout of the user on the exercise device based on the current performance level of the user and the current geographical characteristic being traversed by the user to encourage the user to achieve the target biometric parameters if the one or more biometric parameters of the user during the workout do not conform to the target biometric parameters.

* * * * *